United States Patent [19]

Woytowich

[11] Patent Number: 4,527,763

[45] Date of Patent: Jul. 9, 1985

[54] DETACHABLE TOOL AND PAINT CAN PLATFORM FOR LADDER

[76] Inventor: Nicholas Woytowich, 542 Springfield Rd., Linden, N.J. 07036

[21] Appl. No.: 607,810

[22] Filed: May 7, 1984

[51] Int. Cl.[3] ..... E06C 7/14

[52] U.S. Cl. ..... 248/238; 182/129

[58] Field of Search ..... 182/129, 120, 134; 248/238, 210

[56] References Cited

U.S. PATENT DOCUMENTS

| | | | |
|---|---|---|---|
| 929,291 | 7/1909 | Dawkins | 248/238 |
| 2,837,306 | 6/1958 | Elm | 248/210 |
| 3,004,622 | 10/1961 | Ringer | 182/134 |
| 3,593,951 | 7/1971 | Warner | 248/210 |
| 3,822,847 | 7/1974 | Emmons | 248/210 |
| 3,829,051 | 8/1974 | Emmons | 248/238 |
| 3,998,416 | 12/1976 | Benolkin | 248/210 |
| 4,222,541 | 9/1980 | Cillis | 248/210 |
| 4,445,659 | 5/1984 | La Chance | 248/210 |

*Primary Examiner*—Reinaldo P. Machado
*Attorney, Agent, or Firm*—Rohm & Monsanto

[57] ABSTRACT

A platform for supporting paint, tools, and other articles is formed of first and second platform members which communicate with a side rail of a ladder tensively and compressively, respectively. Each of the platform members is provided with apertures therethrough, at least one of the members having slot-shaped apertures, for adjustably securing the platform members to one another. In a preferred embodiment, the platform members are provided with respective serrated plate members which communicate grippingly with the side rail of the ladder. The platform may be provided with a paint tray for accommodating a paint can, and a tool or article holder. The present platform can be located anywhere along the side rail of the ladder and does not rely upon the rungs. A safety arrangement includes a spring for applying a biasing downward force which reduces the possibility of accidental disengagement of the platform from the side rail of the ladder.

20 Claims, 2 Drawing Figures

DETACHABLE TOOL AND PAINT CAN PLATFORM FOR LADDER

BACKGROUND OF THE INVENTION

This invention relates generally to ladder-mounted platform arrangements, and more particularly to a paint can and tool support platform which is detachable and which is formed of a pair of platform members which communicate with the ladder tensively and compresively, respectively.

It is well known that persons working at altitudes on a ladder generally require a platform or holder within convenient reach of the work person for supporting paint, paint brushes, tools, and other related items. This need for a platform has been addressed in the prior art by a variety of approaches to filling the need. However, all of the previously proposed solutions fall short in one or more ways.

In addition to being stable and secure during use, it is highly desirable that a platform used on a ladder be installable at any location therealong. Such adjustability of the location at which the platform is installed permits increased comfort for the work person, thereby reducing worker fatigue. It is well known that the probability of a ladder accident increases with worker fatigue. In addition, precise adjustability of the location of the platform advantageously reduces the motions a work person must perform when reaching toward the platform.

It is also highly desirable that a platform for use with a ladder be easily detachable so that it may be relocated along the ladder with but little effort. Such facility in relocating the platform will not only save worker time, thereby reducing work costs, but will also further ladder safety.

The prior art approaches to ladder platforms seem to solve one of the foregoing problems at the expense of the other. For example, U.S. Pat. No. 3,822,847 describes a detachable support tray for a ladder; the support tray having a pair of hook members which engage with a side rail of the ladder. It is a problem with this known tray, however, that it relies upon the rungs of the ladder to prevent the tray from sliding down the rail of the ladder. Thus, this known tray can be installed on a ladder only on locations along the ladder corresponding to the location of ladder rungs. The smallest increment of placement adjustment for this known tray is equivalent to the distance between the rungs. Additionally, since the lower hook engages the inside, or rung side, of the ladder rail, the known tray can not be used on ladders where such a lower hook would interfere with a rung.

The foregoing problem is not present in the tray support attachment described in U.S. Pat. No. 4,222,541. This known tray, however, requires loosening of two wing nuts arranged in a clamp configuration if it is desired to move the tray along the ladder rail. Moreover, since loosening of the clamp will permit sliding travel along the rail only within two rungs, the clamp must be partially disassembled if relocation at a distance greater than the length between rungs is desired. Thus, complex disassembly must be performed to effect relocation of the tray.

It is, therefore, an object of this invention to provide a platform for use with a ladder which is simple and inexpensive.

It is another object of this invention to provide a platform which is easily installed and detached during use.

It is a further object of this invention to provide a platform for supporting articles for use by a work person while on a ladder, the platform being locatable substantially anywhere along the rail of the ladder.

It is still another object of this invention to provide a platform for use with a ladder wherein disassembly of the portion of the platform which engages with the ladder is not required.

It is also an object of this invention to provide a safety arrangement for a platform of the type which is used with a ladder.

It is still a further object of this invention to provide a coupling arrangement for a platform for use with a ladder wherein the engagement force between the platform and the ladder side rail increases as a load is placed on the platform.

SUMMARY OF THE INVENTION

The foregoing and other objects are achieved by this invention which provides a detachable platform which is detachably engagable with a side rail of a ladder to provide a substantially horizontal support surface. The detachable platform has a platform member which forms, on one side thereof, the substantially horizontal support surface. A tensile coupling member is affixed to the platform member and communicates with the inside of the side rail of the ladder. A compression member is in slidable communication with the under side of the platform member and engages compresively with the outside of the side rail of the ladder. The platform member and the compression coupling member are detachably coupled to one another by a locking arrangement, which may include a bolt and a wing nut engaged therewith.

The platform member and the compression coupling member, which may be considered as a second platform member, are provided, in one embodiment, with serrated edges which improve the communication between the ladder and the platform. Preferably, such serrated edges are formed of a metallic material, such as steel.

In accordance with the invention, the platform may be provided with a paint can tray which is configured to accomodate the paint can, and thereby reduce the possibility that the paint can might be accidently dislodged from the platform. In a preferred embodiment, the bolts which secure the platform member and the compression coupling member are also passed through the paint can tray so as to insure that the tray is affixed securely to the platform.

In accordance with a further embodiment of the invention, the platform is provided with a container which may be affixed thereto for containing a plurality of articles, such as tools, nails, and screws.

In use, the platform member and the compression coupling member are locked with respect to one another in positions corresponding to the thickness of the side rail of the ladder. In one highly advantageous embodiment of the invention, the platform is removed simply by lifting the distal end of the platform so as to disengage the serrated edges from their respective sides of the side rail of the ladder. The platform is then movable along the rail to a new location, such as to the opposite side rail, or removable altogether.

A safety arrangement is provided for applying a downward, biasing force to the platform. Such a biasing force increases the force of the engagement between the serrated edges and the side rail of the ladder. In one embodiment, the safety arrangement is but a hook which engages around the side rail of the ladder and a tension spring which couples at one end thereof to the hook, and at its other end to a distal portion of the platform. The hook may be serrated where it engages the side rail.

It is a feature of the present invention that the engagement force which tends to secure the platform to the side rail of the ladder is increased as a load is placed on the platform. Thus, downward sliding of the platform along the side rail is prevented irrespective of whether or not the tensile coupling member rests upon a rung of the ladder.

BRIEF DESCRIPTION OF THE DRAWINGS

Comprehension of the invention is facilitated by reading the following detailed description in conjunction with the annexed drawings, in which.

DETAILED DESCRIPTION

Figure 1:
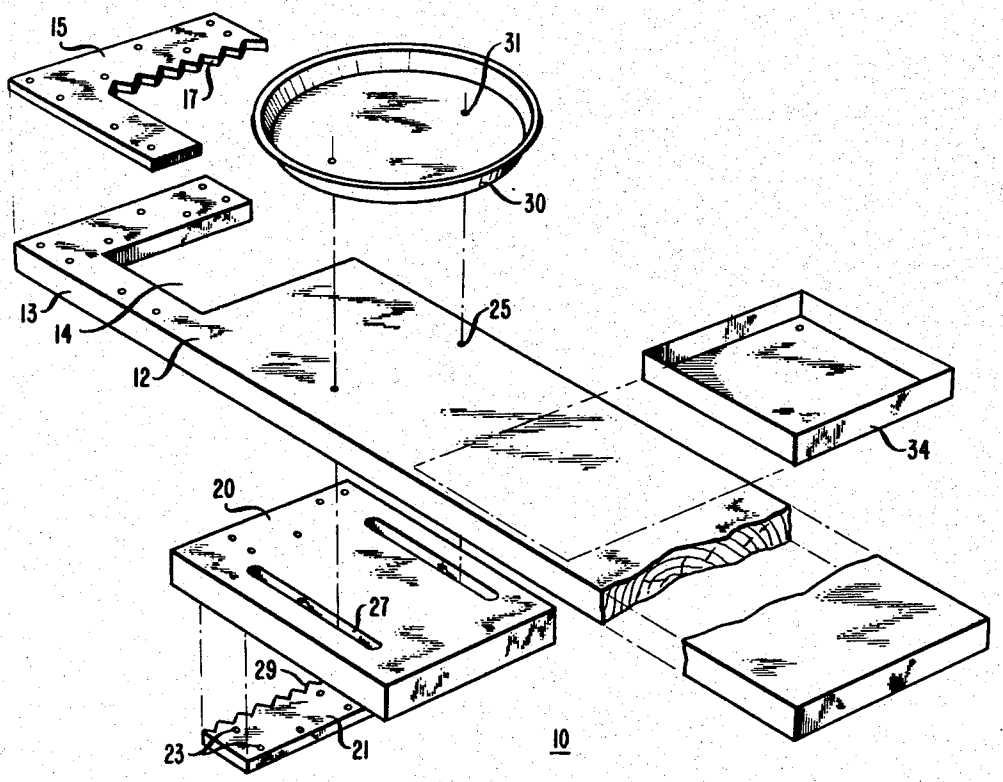
FIG. 1 is an exploded, isometric representation of a paint can and tool platform constructed in accordance with the principles of the invention.

FIG. 1 is an exploded, isometric representation of a platform arrangement 10 having a platform member 12 having a tension portion 13 surrounding a cutout portion 14 which will accomodate a side rail of a ladder (not shown in this figure). A serrated plate member 15 is arranged to overlie tension portion 13. Serrated plate member 15 may be formed of a suitable, strong material, such as steel, and is provided with serration teeth 17 for gripping the side rail of the ladder in a manner which will be described hereinbelow with respect to FIG. 2.

As shown in FIG. 1, the platform arrangement 10 is additionally provided with a compression member 20, which appears as a second platform member, and is arranged to underlie platform member 12. A compression plate 21 is affixed to the underside of compression member 20 by any known means, including screws arranged through hole 23 in the compression plate. A similar mounting arrangement may be used to affix serrated plate member 15 to the top surface of platform member 12 in the vicinity of tension portion 13.

In this embodiment, platform member 12 is provided with a plurality of through holes 25 which, when platform member 12 and compression member 20 are arranged adjacent to one another, register with slots 27 in the compression member. An easily loosenable locking arrangement, such as a screw and wing nut (not shown in this figure) is inserted through hole 25 and slot 27. Slots 27 permit compression member 20 to be adjustably securable to platform member 12. As will be described hereinbelow, the precise location of compression member 20 with respect to platform member 12 depends upon the thickness of the ladder rail.

Platform arrangement 10 may be provided with a paint tray 30 having through-holes 31 for accomodating therein the bolts (not shown) which are used to secure the platform and compression members to each other. Of course, paint tray 30 may be provided with a mechanism (not shown) for securing a paint can thereto.

In a further specific illustrative embodiment of the invention, platform arrangement 10 is provided with an article holder 34. Article holder 34 may be secured to platform member 12 by any known means.

Figure 2:
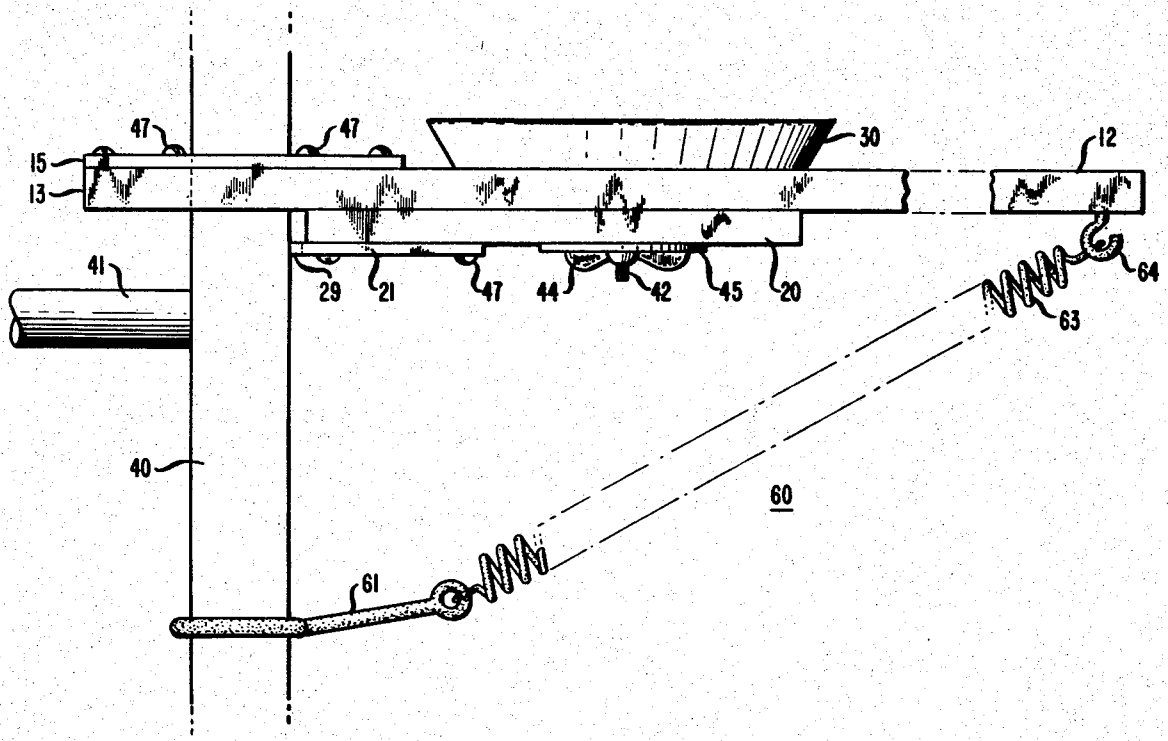
FIG. 2 is a side plan view of the platform of FIG. 1 installed on a side rail of a ladder.

FIG. 2 is a side plan view of platform arrangement 10 installed on a side rail 40 of a ladder. As shown, the platform arrangement does not require placement adjacent to a rung, such as rung 41. As shown in this specific illustrative embodiment, compression member 20 communicates with side rail 40 via compression plate 21, and more specifically, a plurality of serration teeth 29. As noted hereinabove, platform and compression members 12 and 20 are secured to each other via a bolt 42 having a wing nut 44 engaged therewith. In this embodiment, a washer 45 is interposed between the wing nut and the compression member. Additionally in this embodiment, serrated plate member 15 and compression plate 21 are affixed to the platform and compression members, respectively, via a plurality of screws 47.

In addition to the foregoing, the inventive platform arrangement is further provided with a safety arrangement 60 which, in this embodiment, is formed of a hook member 61, a tension spring 63, (shown schematically only) and a mounting hook 64 near the distal end of the platform arrangement. Hook 61 is arranged to engage side rail 40 of the ladder, such that spring 63 experiences a tensile force which urges platform member 12 downwardly. Such a downward force causes serration teeth 29 of compression plate 21 to engage more firmly with side rail 40 of the ladder. Similarly, serration teeth 17 (not shown in this figure) of serrated plate member 15 communicate more firmly with the inward, or rung, side of the side rail.

It is an advantage of the present invention even though the ladder may be used at an angle which is less than ninety degrees with respect to the vertical, the platform arrangement can be maintained horizontal without the need for complex pivoting mechanisms such as have been used in the prior art. In addition, as a load, such as a paint can, is placed on the platform arrangement, the serration teeth of the serrated plate member and the compression plate communicate more firmly with the side rail of the ladder, thereby virtually eliminating the possibility that the platform arrangement will slide down the side rail.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawings and description in this disclosure are profferred to facilitate comprehension of the invention and should not be construed to limit the scope thereof.

What is claimed is:

1. A detachable platform of the type which is detachably engagable with a side rail of a ladder having inward and outward sides, to provide a substantially horizontal support surface, the detachable platform comprising:

a platform member having a first surface for forming the substantially horizontal support surface and a second surface arranged substantially parallel to said first surface;

a tensile coupling member coupled to said platform member and arranged to communicate with the inward side of the side rail of the ladder;

a compression coupling member having a slide surface for communicating slidably with said second surface of said platform member, said compression coupling member being arranged to cooperate with said tensile coupling member and communicate with the outward side of the side rail of the ladder; and locking means communicating with said platform member and said compression coupling member for locking said platform member and said compression coupling member to one another at positions relative to one another corresponding to a distance between the inward and outward sides of the side rail of the ladder.

2. The detachable platform of claim 1 wherein said tensile coupling member is provided with serrated tension means for engaging with the inward side of the side rail of the ladder.

3. The detachable platform of claim 2 wherein said serrated means comprises a serrated tension plate arranged to overlie said platform member and having a tension support platform for reinforcing said platform member.

4. The detachable platform of claim 3 wherein said serrated tension plate is affixed to said platform member.

5. The detachable platform of claim 1 wherein said compression coupling member is provided with a serrated compression means for engaging the outward side of the side rail of the ladder.

6. The detachable platform of claim 5 wherein said serrated compression means comprises a serrated compression plate fixed to said compression coupling member.

7. The detachable platform of claim 1 wherein said platform member is provided with an aperture therethrough and said compression coupling member is provided with a slot-shaped aperture therethrough, said aperture and said slot-shaped aperture being arranged in registration with one another.

8. The detachable platform of claim 7 wherein said locking means comprises a threaded bolt member and a nut threadedly engaged therewith, said threaded bolt member being arranged within said aperture and said slot-shaped aperture.

9. The detachable platform of claim 1 wherein there is further provided paint tray means having a circular configuration with an upturned perimeter for securing a paint can, said paint tray means being fixed to said platform member.

10. The detachable platform of claim 1 wherein there is further provided container means fixed to said platform means for containing at least one article.

11. The detachable platform of claim 1 wherein there is further provided safety means for securing the detachable platform to the ladder to reduce the possibility of accidental disengagement from the side rail of the ladder.

12. The detachable platform of claim 11 wherein said safety means comprises:

hook means for coupling with the side rail of the ladder; and flexible coupling means for coupling between said hook means and a coupling point on said platform member.

13. The detachable platform of claim 12 wherein said flexible coupling member comprises a tension spring having a rest-position length which is shorter than a distance between said hook means and said coupling point on said platform member, whereby said tension spring exerts a force in the vicinity of a distal portion of said platform member with respect to said tensile coupling member and said compression coupling member tending to enforce said communications between said tensile and compression coupling members, and the side rail of the ladder.

14. A platform for a ladder, the platform comprising:

first and second platform members, said first platform member being in tensile communication with the ladder, and said second platform member being in compressive communication with the ladder, said first and second platform members being in surface-to-surface communication with each other; and locking means communicating with said first and second platform members for locking said first and second platform members to one another at a surface-to-surface position selected in response to a dimension of the ladder.

15. The platform of claim 14 wherein there is further provided first and second ladder engagement means arranged on said first and second platform members, respectively, for reinforcing said first and second platform members.

16. The platform of claim 15 wherein said first and second ladder engagement means are provided with serrated edges to insure a firm gripping communication with the ladder.

17. The platform of claim 14 wherein there is further provided paint can tray means for supporting a paint can.

18. The platform of claim 17 wherein said paint can tray means is secured to the platform via said locking means.

19. The platform of claim 14 wherein there is further provided safety means for biasing said first and second platform members into said communication with the ladder.

20. The platform of claim 19 wherein said safety means comprises resillient means for producing a biasing force.

* * * * *